US007201628B2

(12) United States Patent
Spenneberg

(10) Patent No.: US 7,201,628 B2
(45) Date of Patent: Apr. 10, 2007

(54) RACE TRACK GAME SYSTEM

(76) Inventor: Evan Spenneberg, 2526 Carriage Lamp Dr., Jacksonville, FL (US) 32247

( * ) Notice: Subject to any disclaimer, the term of this patent is extended or adjusted under 35 U.S.C. 154(b) by 0 days.

(21) Appl. No.: 11/126,602

(22) Filed: May 11, 2005

(65) Prior Publication Data

US 2006/0183403 A1 Aug. 17, 2006

Related U.S. Application Data

(60) Provisional application No. 60/574,600, filed on May 26, 2004.

(51) Int. Cl.
*A63H 33/00* (2006.01)
*A63H 23/04* (2006.01)

(52) U.S. Cl. ..... 446/154; 446/179; 463/64

(58) Field of Classification Search ..... None
See application file for complete search history.

(56) References Cited

U.S. PATENT DOCUMENTS 3,896,735 A * 7/1975 Fischer ..... 104/23.2
4,193,470 A * 3/1980 Logan ..... 180/117
4,964,835 A * 10/1990 Suto ..... 446/154
5,045,013 A * 9/1991 Fujitani ..... 446/179
5,658,198 A * 8/1997 Nagasaka et al. ..... 463/64
6,499,409 B1 * 12/2002 Niederer et al. ..... 104/138.1
6,762,586 B2 * 7/2004 Choi ..... 320/107

* cited by examiner

*Primary Examiner*—Kien Nguyen
(74) *Attorney, Agent, or Firm*—Edward P. Dutkiewicz

(57) ABSTRACT

A car has a front and a back with a chamber there within. The back of the car includes a fan with a motor. The back of the car also includes a hinged fin extending rearwardly with a driver and a linkage. A source of power is located in the chamber and is coupled to the motor and the driver. A control assembly includes a receiver within the chamber coupled to the motor and the driver. The control assembly also includes a hand held transmitter having a plurality of dials to control the car. Lastly, a race track has an upper plate with apertures with a pump for creating an air flow upwardly through the apertures for supporting the car there above.

4 Claims, 3 Drawing Sheets

FIG 4
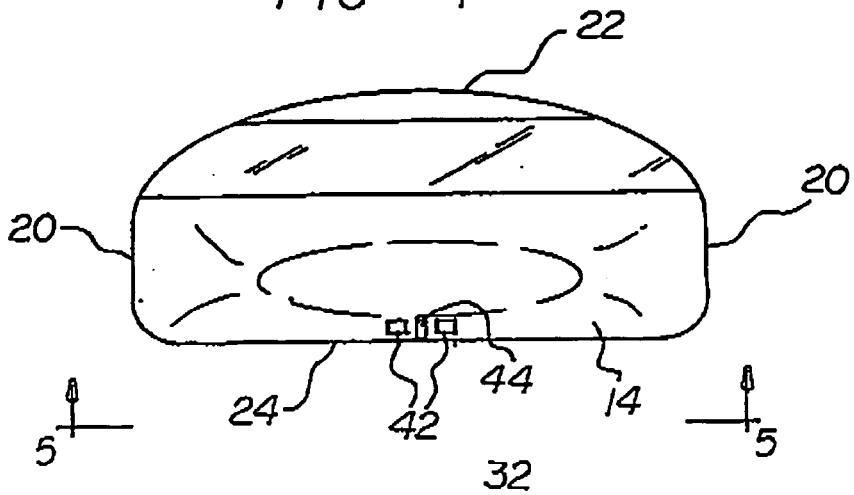
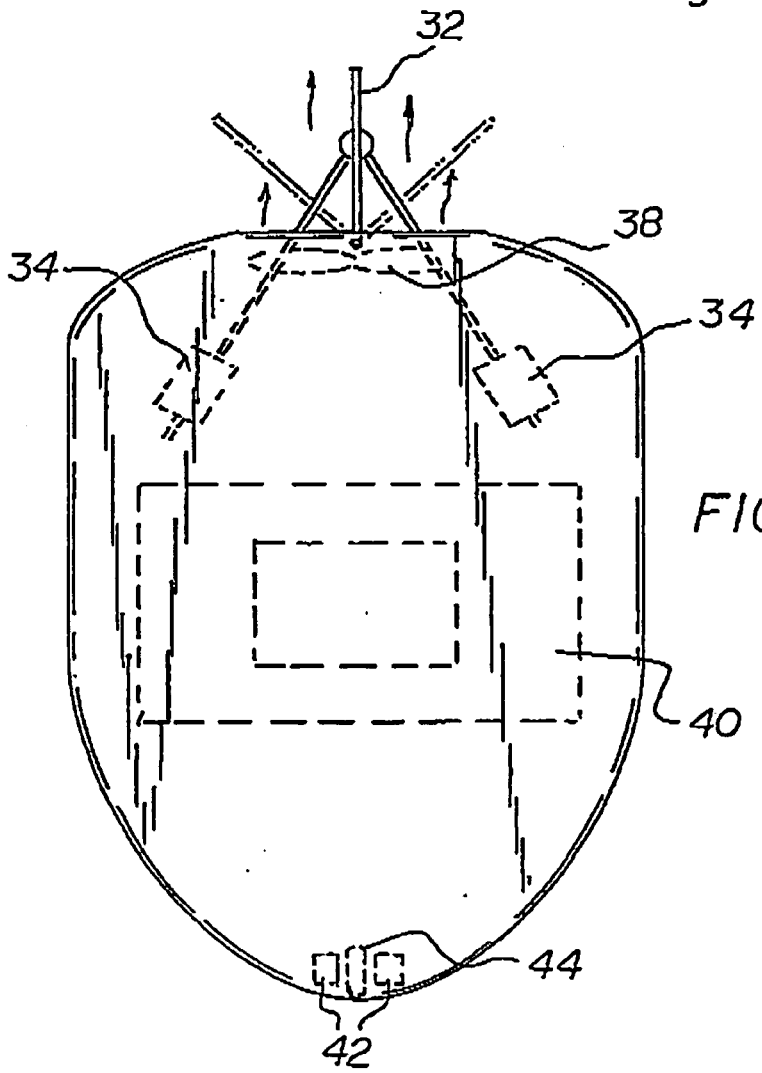
FIG 5

FIG 6
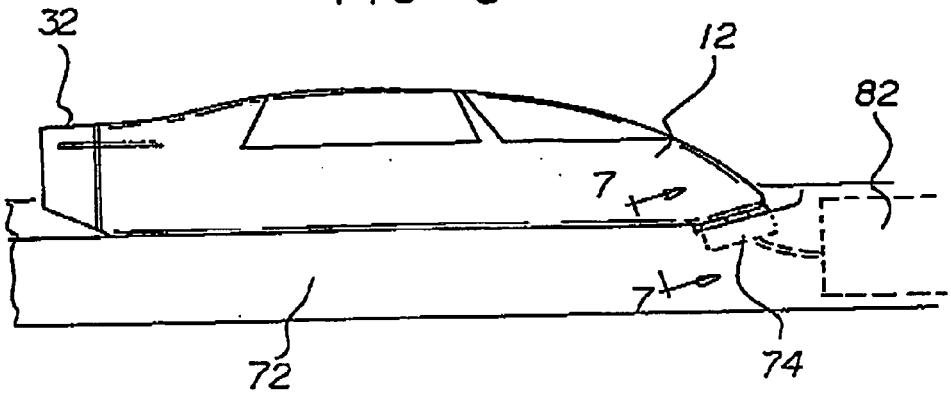
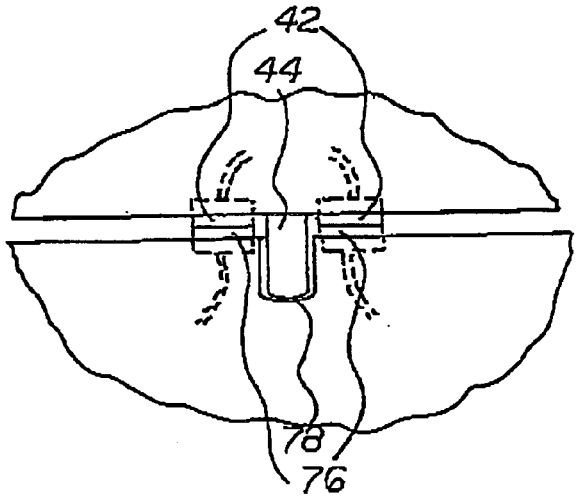
FIG 7

RACE TRACK GAME SYSTEM

RELATED APPLICATION

The present application is based upon U.S. Provisional Patent Application Ser. No. 60/574,600 filed May 26, 2004, the subject matter of which is incorporated herein by reference.

BACKGROUND OF THE INVENTION

1. Field of the Invention

The present invention relates to a race track game system and more particularly pertains to racing cars on a track with the cars on a cushion of air.

2. Description of the Prior Art

The use of games with cars is known in the prior art. More specifically, games with cars previously devised and utilized for the purpose of racing are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 3,987,581 to Brown issued Oct. 26, 1976 relates to a controlled multiple track toy system with modular attachments. U.S. Pat. No. 4,076,242 to Joseph issued Feb. 28, 1978 relates to a game device with a playing surface of pressurized air.

While these devices fulfill their respective, particular objectives and requirements, the aforementioned patents do not describe race track game system that allows racing cars on a track with the cars on a cushion of air.

In this respect, the race track game system according to the present invention substantially departs from the conventional concepts and designs of the prior art, and in doing so provides an apparatus primarily developed for the purpose of racing cars on a track with the cars on a cushion of air.

Therefore, it can be appreciated that there exists a continuing need for a new and improved race track game system which can be used for racing cars on a track with the cars on a cushion of air. In this regard, the present invention substantially fulfills this need.

SUMMARY OF THE INVENTION

In view of the foregoing disadvantages inherent in the known types of games with cars now present in the prior art, the present invention provides an improved race track game system. As such, the general purpose of the present invention, which will be described subsequently in greater detail, is to provide a new and improved race track game system and method which has all the advantages of the prior art and none of the disadvantages.

To attain this, the present invention essentially comprises a race track game system for racing cars on a track with cars hoovering on a cushion of air. The system comprises, in combination, a plurality of cars. Each car has a front and a back with a center there between. Each car also has between the front and the back two laterally spaced sides as well as a top and a planar bottom with a surface area. Each car is hollow thereby defining a chamber there within. The back of each car includes a fan and a motor adapted to rotate the fan to create a flow of air rearwardly of the car to drive the car in a forward direction. Each car has a fin hinged about a vertical axis and extending rearwardly and adapted to pivot left and right. A pair of fin drivers, with a pair of linkages coupling the fin and the fin drivers, function for causing the car to turn in one direction and the other.

Next provided is a battery located in the chamber in proximity to the center adjacent to the bottom. The battery is adapted to provide power to the motor of the fan and to the fin drivers. A pair of car charger plates with a retention finger extend outwardly from the bottom of the car adjacent to the front. Primary electric lines couple the charger plates to the battery for recharging with secondary electric lines coupling the battery to the fan motor and to the fin drivers.

A control assembly is next provided for each car. Such assembly comprises a receiver centrally located within the chamber resting upon the battery. The receiver is adapted to control the operation of the fan motor by initiating and terminating power to the fan motor and by also increasing and decreasing the speed of the fan motor and, hence, the speed of the car. The receiver is also adapted to control the operation of the fin drivers which controls the direction of movement of the car by pushing and pulling the linkage between the fin and the fin drivers.

A transmitter for each car utilizes a unique signal. A hand held unit supports each transmitter and is operable by a player to remotely control the associated car. The transmitter has a first dial to control the fan motor and, therefore, the speed of the associated car. The transmitter has a second dial to control the fin drivers and, therefore, the direction of the associated car.

Next provided is a race track in an oval configuration upon which the cars are adapted to move. The race track has an upper plate in an essentially horizontal plane with closely and uniformly spaced air apertures over the entire surface of the upper plate and with a pair of side rails in proximity to the upper plate. A plenum is beneath the upper plate with air at a pressure higher than atmospheric pressure. A such pressure is adapted to causes a flow of air upwardly through the apertures of the upper plate to provide an air cushion. The air cushion is thus adapted to create a region of minimized friction over which the cars may move as speed will not be diminished by the retarding forces of friction.

A pit region is next provided within the oval of the track. The pit region has a battery charger into which each car is adapted to insert its car charger plates into contact with the pit charger plates. Such pit charger plates are electrically coupled to the battery charger for recharging its battery. A receiving recess is adapted to couple with the retention finger of a car for secure coupling.

Lastly, a pump is provided within the oval of the track to create a higher air pressure beneath the upper plate and, therefore, the air cushion there above for supporting the cars while racing. The battery charger as well as the pump are coupled to a source of electrical potential.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved race track game system which has all of the advantages of the prior art games with cars and none of the disadvantages.

It is another object of the present invention to provide a new and improved race track game system which may be easily and efficiently manufactured and marketed.

It is further object of the present invention to provide a new and improved race track game system which is of durable and reliable constructions.

An even further object of the present invention is to provide a new and improved race track game system which is susceptible of a low cost of manufacture with regard to both materials and labor, and which accordingly is then susceptible of low prices of sale to the consuming public, thereby making such race track game system economically available to the buying public.

Even still another object of the present invention is to provide a race track game system for racing cars on a track with the cars on a cushion of air.

Lastly, it is an object of the present invention to provide a new and improved race track game system comprising a car having a front and a back with a chamber there within. The back of the car includes a fan with a motor. The back of the car also includes a hinged fin extending rearwardly with a driver and a linkage. A source of power is located in the chamber and is coupled to the motor and the driver. A control assembly includes a receiver within the chamber coupled to the motor and the driver. The control assembly also includes a hand held transmitter having a plurality of dials to control the car. Lastly, a race track has an upper plate with apertures with a pump for creating an air flow upwardly through the apertures for supporting the car there above.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 4 is a front elevational view of the car taken at line 4—4 of FIG. 1.

FIG. 5 is a plan view of the car of the system illustrated in FIG. 1.

FIG. 6 is a side elevational view of the car and pit region taken along line 6—6 of FIG. 3.

FIG. 7 is a cross sectional view taken along line 7—7 of FIG. 6.

The same reference numerals refer to the same parts throughout the various Figures.

DESCRIPTION OF THE PREFERRED EMBODIMENT

Figures 1, 2, 3:
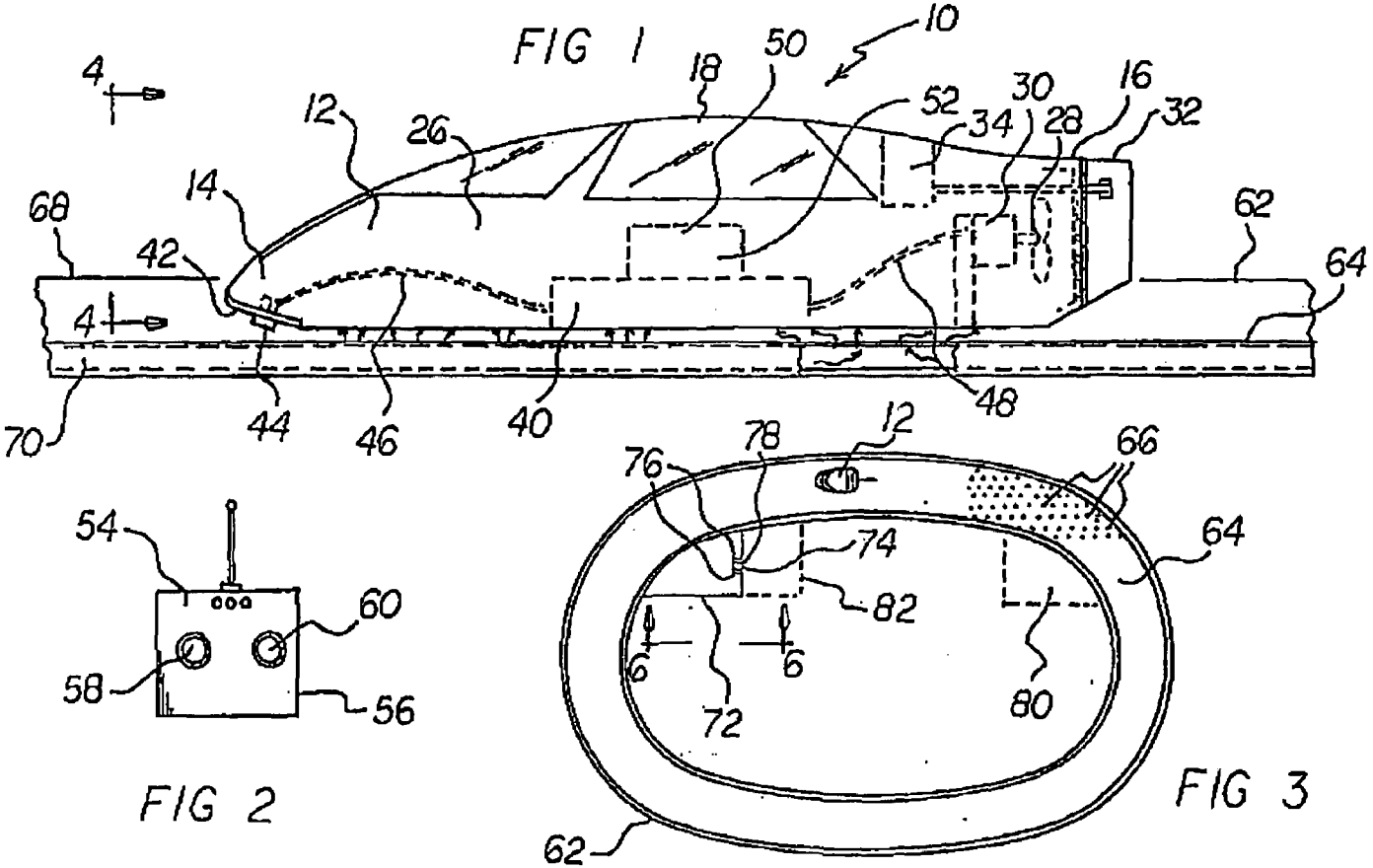
FIG. 1 is a side elevational view of a race track game system constructed in accordance with the principles of the present invention.
FIG. 2 is a front elevational view of a transmitter for use with the car and track of FIG. 1.
FIG. 3 is a plan view of the track portion of the system of the present invention.

With reference now to the drawings, and in particular to FIG. 1 thereof, the preferred embodiment of the new and improved race track game system embodying the principles and concepts of the present invention and generally designated by the reference numeral 10 will be described.

The present invention, the race track game system 10 is comprised of a plurality of components. Such components in their broadest context include a car, a source of power, a control assembly and a race track. Such components are individually configured and correlated with respect to each other so as to attain the desired objective.

More specifically, the invention is a race track game system 10 for racing cars on a track with cars hoovering on a cushion of air. The system comprises, in combination, a plurality of cars 12. Each car has a front 14 and a back 16 with a center 18 there between. Each car also has between the front and the back two laterally spaced sides 20 as well as a top 22 and a planar bottom 24 with a surface area. Each car is hollow thereby defining a chamber 26 there within. The back of each car includes a fan 28 and a motor 30 adapted to rotate the fan to create a flow of air rearwardly of the car to drive the car in a forward direction. Each car has a fin 32 hinged about a vertical axis and extending rearwardly and being adapted to pivot left and right. A pair of fin drivers 34 is provided with a pair of linkages 36 coupling the fin and the fin drivers for causing the car to turn in one direction and the other. During operation and use, a player or players may utilize one or a plurality if cars simultaneously.

For each car, there is provided a source of power, preferably a battery 40 located in the chamber in proximity to the center adjacent to the bottom. The battery is adapted to provide power to the motor of the fan and to the fin drivers. A pair of car charger plates 42 in also provided. The charger plates are formed with a retention finger 44 extend outwardly from the bottom of the car adjacent to the front. Primary electric lines 46 couple the charger plates to the battery for recharging. Secondary electric lines 48 couple the battery to the fan motor and to the fin drivers.

A control assembly 50 is provided for each car and comprises a receiver 52 which is centrally located within the chamber resting upon the battery. The receiver is adapted to control the operation of the fan motor by initiating and terminating power to the fan motor and by also increasing and decreasing the speed of the fan motor and, hence, the speed of the car. The receiver is also adapted to control the operation of the fin drivers which controls the direction of movement of the car by pushing and pulling the linkage between the fin and the fin drivers.

Provided next is a transmitter 54 for each car. Each transmitter utilizes a unique signal. A hand held unit 56 supports each transmitter operable by a player to remotely control the associated car. The transmitter has a first dial 58 to control the fan motor and, therefore, the speed of the associated car. The transmitter has a second dial 60 to control the fin drivers and, therefore, the direction of the associated car.

A race track 62 in an oval configuration is next provided. The cars are adapted to move across and around the race track. The race track has an upper plate 64 in an essentially horizontal plane with closely and uniformly spaced air apertures 66 over the entire surface of the upper plate. A pair of side rails 68 in proximity to the upper plate keep the cars from falling off of the track. A plenum 70 is provided beneath the upper plate with air at a pressure higher than atmospheric pressure. Such pressure is adapted to causes a flow of air upwardly through the apertures of the upper plate to provide an air cushion. The air cushion is thus adapted to create a region of minimized friction over which the cars may move as speed will not be diminished by the retarding forces of friction.

A pit region 72 is formed within the oval of the track. The pit region has a battery charger 74 into which each car is adapted to insert its car charger plates 42 into contact with the pit charger plates 76. Such charger plates are electrically coupled to the battery charger for recharging its battery. A receiving recess 78 is adapted to couple with the retention finger 44 of a car for secure coupling.

Lastly, a pump 80 is provided within the oval of the track. The pump is adapted to create a higher air pressure beneath the upper plate and the air cushion there above. The battery charger as well as the pump are coupled to a source of electrical potential 82, preferably through electrical lines coupled to an electrical outlet.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A race track game system comprising:

a car having a front and a back with a chamber there within, the back of the car including a fan with a motor, the back of the car also including a hinged fin extending rearwardly with a driver and a linkage;

a source of power located in the chamber coupled to the motor and the driver;

a control assembly including a receiver within the chamber coupled to the motor and the driver, the control assembly also including a hand held transmitter having a plurality of dials to control the car; and a race track having an upper plate with apertures and with a pump for creating an air flow upwardly through the apertures for supporting the car there above.

2. A race track game system as set forth in claim 1 wherein the source of power of the car is a rechargeable battery and with a charge plate in the front of the car coupled to battery.

3. A race track game system as set forth in claim 1 and further including a plurality of cars with a control assembly for each car.

4. A race track game system for racing cars on a track with cars hoovering on a cushion of air comprising, in combination:

a plurality of cars, each car having a front and a back with a center there between, each car also having between the front and the back two laterally spaced sides as well as a top and a planar bottom with a surface area, each car being hollow thereby defining a chamber there within, the back of each car including a fan and a motor adapted to rotate the fan to create a flow of air rearwardly of the car to drive the car in a forward direction, each car having a fin hinged about a vertical axis and extending rearwardly and being adapted to pivot left and right, a pair of fin drivers with a pair of linkages coupling the fin and the fin drivers for causing the car to turn in one direction and the other;

a battery located in the chamber in proximity to the center adjacent to the bottom and adapted to provide power to the motor of the fan and to the fin drivers, a pair of car charger plates with a retention finger extend outwardly from the bottom of the car adjacent to the front, primary electric lines couple the charger plates to the battery for recharging with secondary electric lines coupling the battery to the fan motor and to the fin drivers;

a control assembly for each car comprising a receiver centrally located within the chamber resting upon the battery, the receiver adapted to control the operation of the fan motor by initiating and terminating power to the fan motor and by also increasing and decreasing the speed of the fan motor and, hence, the speed of the car, the receiver also adapted to control the operation of the fin drivers which controls the direction of movement of the car by pushing and pulling the linkage between the fin and the fin drivers;

a transmitter for each car utilizing a unique signal and with a hand held unit supporting each transmitter operable by a player to remotely control the associated car, the transmitter having a first dial to control the fan motor and, therefore, the speed of the associated car, the transmitter having a second dial to control the fin drivers and, therefore, the direction of the associated car;

a race track in an oval configuration upon which the cars are adapted to move, the race track having an upper plate in an essentially horizontal plane with closely and uniformly spaced air apertures over the entire surface of the upper plate with a pair of side rails in proximity to the upper plate, a plenum beneath the upper plate with air at a pressure higher than atmospheric pressure, such pressure adapted to causes a flow of air upwardly through the apertures of the upper plate to provide an air cushion, the air cushion thus adapted to create a region of minimized friction over which the cars may move as speed will not be diminished by the retarding forces of friction during operation and use;

a pit region within the oval of the track having a battery charger into which each car is adapted to insert its car charger plates into contact with the pit charger plates which are electrically coupled to the battery charger for recharging its battery and with a receiving recess adapted to couple with the retention finger of a car for secure coupling; and a pump within the oval of the track adapted to create a higher air pressure beneath the upper plate and the air cushion there above, the battery charger as well as the pump being coupled to a source of electrical potential.

* * * * *